US005908134A

United States Patent [19]

Hale et al.

[11] Patent Number: 5,908,134

[45] **Date of Patent: *Jun. 1, 1999**

[54] TUBULAR ABOVE GROUND GAS STORAGE VESSEL

[75] Inventors: George Carl Hale; Charles Michael Coldren, both of Edmond; Robert K. Meek, Norman, all of Okla.

[73] Assignee: The Rosalind Hale Revocable Trust, UTA George Carl Hale, Trustee, Edmond, Okla.

[ * ] Notice: This patent is subject to a terminal disclaimer.

[21] Appl. No.: 08/916,622

[22] Filed: Aug. 22, 1997

Related U.S. Application Data

[63] Continuation of application No. 08/405,290, Mar. 16, 1995, abandoned, which is a continuation-in-part of application No. 08/026,954, Mar. 5, 1993, Pat. No. 5,429,268.

[51] Int. Cl.[6] ..... B65D 53/00

[52] U.S. Cl. ..... 220/582; 220/254

[58] Field of Search ..... 220/582, 254, 220/584; 206/443, 446

[56] References Cited

U.S. PATENT DOCUMENTS

| | | | |
|---|---|---|---|
| 636,083 | 10/1899 | Sweetser et al. . | |
| 2,016,227 | 10/1935 | Clausen | 220/3 |
| 2,332,462 | 10/1943 | Nilson | 220/3 |
| 2,481,478 | 9/1949 | Petroe | 62/91.5 |
| 2,661,113 | 12/1953 | Benson | 220/3 |
| 2,699,596 | 1/1955 | Aronson | 29/540 |
| 3,024,938 | 3/1962 | Watter | 220/5 |
| 3,246,794 | 4/1966 | Marshall | 220/67 |
| 3,439,405 | 4/1969 | Berman et al. | 29/407 |
| 3,762,448 | 10/1973 | Donohue | 138/171 |
| 3,863,408 | 2/1975 | Closner et al. | 52/224 |
| 4,004,706 | 1/1977 | Guldenfels et al. | 220/3 |
| 4,008,826 | 2/1977 | Rogers | 220/3 |
| 4,320,848 | 3/1982 | Dye et al. | 220/72 |
| 4,589,564 | 5/1986 | Olster et al. | 220/3 |
| 4,724,975 | 2/1988 | Leventry | 220/3 |
| 4,736,779 | 4/1988 | Bernauer | 141/4 |
| 4,846,088 | 7/1989 | Fanse et al. | 114/72 |
| 4,964,524 | 10/1990 | Halene | 220/3 |
| 5,346,096 | 9/1994 | Diersch et al. | 220/679 |
| 5,429,268 | 7/1995 | Hale et al. | 220/582 |

*Primary Examiner*—Joseph M. Moy
*Attorney, Agent, or Firm*—Head, Johnson & Kachigian

[57] ABSTRACT

This invention includes an above ground compressed gas storage vessel of tubular or cylindrical configuration. A plug assembly is inserted into the tube and retained therein by a tri-part ring positioned within a groove of larger internal diameter than that of the tube and retained together with said plug. O-rings or a singular packing assembly would be used to seal the plug to the internal diameter of the tube to prevent the escape of gas. A plurality of cylinders are secured in a parallel arrangement using a support structure to increase gas storage capacity while taking up a minimal amount of ground space.

13 Claims, 7 Drawing Sheets

TUBULAR ABOVE GROUND GAS STORAGE VESSEL

RELATED APPLICATIONS

This is a continuation application of U.S. Ser. No. 08/405,290 filed on Mar. 16, 1995, abandoned, which is a continuation-in-part U.S. application Ser. No. 08/026,954 filed Mar. 5, 1993, now U.S. Pat. No. 5,429,268.

BACKGROUND OF THE INVENTION

1. Field of the Invention

This invention relates to pressure vessels used for the storage of gases, particularly compressed natural gas (CNG) above ground.

2. Description of the Related Art

The use of CNG as an alternative motor vehicle fuel is on the rise. Some of the reasons include the fact that the use of CNG is cleaner with fewer emissions producing up to 99% less carbon monoxide than gasoline with almost no sulphur dioxide, no particulates and 85% less reactive hydrocarbons than gasoline. In addition, it provides better fuel economy and costs less than gasoline. There is some indication that it will provide less vehicle maintenance. Natural gas vehicles are safer than gasoline powered vehicles, since natural gas requires a temperature of 1300° fahrenheit (704° centigrade) to ignite, whereas gasoline ignites at a lower temperature of 842° fahrenheit (450° centigrade). Being lighter than air, CNG quickly dissipates into the atmosphere in the event of a spill or leak. Natural gas is a domestic, readily available, abundant, natural resource. Many more vehicles each year are being converted to run on clean burning natural gas.

Increasing use of CNG has required the ability to supply convenient storage and availability to vehicles so converted to natural gas.

Pressure vessels used for the storage of gases have traditionally been expensive due to the time and labor intensive manufacturing processes. Conventional methods of manufacture have been by welding component parts together or forging of the vessel. Both of these methods are expensive and time consuming. As a result, a very costly pressure vessel is produced requiring long lead times for manufacture. In addition, pressure vessels of conventional construction are extremely heavy, thereby causing difficulties and added cost in handling and transportation.

Welding of component parts of a pressure vessel is accomplished by obtaining a piece of pipe of desired length and specifications and welding a forged hemispherical section on each end. Each hemispherical section would have an opening therein to allow for gas access. Welding produces a pressure vessel with seams that are a line of reduced strength of the vessel. In addition, welding is a very labor intensive process.

Difficulties arise in the welding process when two sections of differing thicknesses are welded together. Joining of this type may require additional machining of the pieces to produce a taper in order for a satisfactory weld to be obtained.

A pressure vessel may also be constructed by welding sections of differing shapes to one another. An example of this is disclosed in the Watter patent, U.S. Pat. No. 3,024,938. Such construction also produces a vessel containing seams therein.

An alternative conventional method of construction of pressure vessels is accomplished through forging at high temperatures. Such methods of manufacture are equally as labor intensive and time consuming as those that are welded.

In using the forging method, a section of pipe of a desired length is obtained. In this method, in order to produce the hemispherical heads of the pressure vessel, the pipe is forged at extremely high temperature and the ends of the pipe are swaged closed. Once this is completed, the entire vessel is heat treated. After heat treatment, the swaged closed ends of the pipe are machined. The resultant pressure vessel is then cleaned and tested according to applicable specifications. This manufacturing process produces a seamless vessel, however, the cost of such production are high due to the heating and machining requirements.

Therefore, a need in the industry exists for a pressure vessel that is capable of storage of compressed gases, such as compressed natural gas which requires no expensive forging or welding. A need also exists for a pressure vessel where the manufacture time is expedited over conventional methods. A further need in the industry exists which conforms to ASME specifications yet is not as heavy as conventional vessels.

SUMMARY OF THE INVENTION

It is the purpose of the present invention to obtain a pressure vessel capable of above ground compressed storage of gases, such as compressed natural gas meeting ASME specifications.

An additional purpose is to provide an apparatus for storage of compressed gases which is constructed without the requirement of forging or welding. Such construction facilitates and expedites the manufacturing process resulting in significant cost savings over traditional designs. The pressure vessels of this invention are capable of use in a plurality while taking up minimal ground space.

An apparatus to accomplish this purpose is comprised of a seamless cylinder or tube requiring no hot or cold forming or welding. This seamless tube is rolled to American Society of Mechanical Engineers (ASME) or American Petroleum Institute (API) standards. Electric Resistance Weld tubes, butt weld tubes, or common oilfield casing could be used instead of seamless tubes. Once a desired length of tube is obtained, threads are machined on each end. A head or cap with threads machined on its inner surface is constructed. The threads of the cap mate the threads of the tube and a cap is screwed onto each end of the tube. Since both the tube and cap are threaded so that the threads of the tube receive the threads of the cap, no welding, or re-heat treating is required to produce the necessary seal in order to create the pressure vessel. Therefore, this design is very effective for use as a pressure vessel while also being easy to manufacture at minimal cost. The tubular gas storage vessels of this invention may be designed to meet ASME or DOT specifications. Typically, such vessels must be capable of operating at pressure in the range of 4,000 to 5,000 psi with a 4:1 safety factor and design burst of over 20,000 psi.

A cap is screwed on each end of the tube. Each cap contains a passage which is threaded to mate a reducing bushing. The threaded reducing bushing is screwed inside the passage of the cap to allow access of a gas port of required diameter. In order to provide this access, at least a partially threaded central passage is machined into the reducing bushing.

A gas port with threads mating those of the partially threaded central passage of the reducing bushing can then be screwed into the reducing bushing to provide gas flow as required.

Depending upon the particular application of the pressure vessel, the other end of the tube with a second cap screwed thereon may be fitted with a second reducing bushing and gas port or may be sealed by screwing a threaded plug into the reducing. bushing to prevent the escape of the contents of the vessel. When the vessel is fit with this reducing bushing with a second gas port, a plurality of vessels may be connected together, or in any other manner as required.

An alternative closure assembly includes a cap or plug which is designed to fit internally of the tube. This plug contains a shoulder portion of reduced diameter onto which a packing assembly is attached. The packing assembly consists of alternating series of chevron rings stacked against one another in sawdust type packing material known in the art and moldable around the plug. This packing assembly seals the end of the tube to prevent the escape of gas stored in the tube. Other forms of packing include a bevelled packing member at the internal end of the plug and at least one and, preferably, a plurality of O-rings.

The plug is secured in the tube by a retainer ring having a diameter larger than the inner diameter of the tube. The retainer ring fits into a groove cut in the inner diameter and is constructed in three sections to facilitate installation. The plug assembly is secured in the tube by a washer and a plurality of bolts that extend through the washer and retaining ring to screw into the plug.

Passages are drilled partially through the plug which intersect with its shoulder so that the packing assembly can be energized to provide a proper seal in the tube. Fittings secure the passages once the packing assembly is energized. A drain is drilled through the plug and is sealed by a drain plug. A partially threaded passage extends through the plug, retaining ring, and washer into which a gas port may be inserted.

The other end of the tube can be closed by a similar closure assembly, i.e., using an internal plug as described, or other type of cap. A separate threaded plug can be screwed into the partially threaded center passage of the internal plug. Another alternative is to provide a conduit connecting the partially threaded central passages of a plurality of tubes together, e.g., in series or in any manner as required.

A plurality of pressure vessels may be stacked horizontally and vertically to form a cascade. A cascade provides increased storage capability while taking up a minimal amount of ground space, or footprint especially when arranged in a vertical configuration. This support consists of a pair of vessel clamps which conform to the outer diameter of the tubular pressure vessels. When two such vessel clamps are clamped onto a plurality of vessels and secured together, the vessels are retained at a pre-determined distance from one another.

A second, identical set of vessel clamps are secured a distance from the first set in order to support the entire lengths of the tubular pressure vessels.

Multiple pressure vessels are then positioned by securing them to a support base designed to receive the support brackets. The base receives the support brackets so that they are perpendicular to the ground. When secured, the tubular pressure vessels are secured in a parallel arrangement by the support structure.

In constructing a threaded tubular pressure vessel of this design, the manufacturing process may be expedited in comparison with traditional arrangements since no forging or welding is required. As a result, a tubular above ground gas storage vessel suitable for storage of compressed gases may be manufactured at significant savings in cost and labor.

Other features and advantages of the invention will become apparent in view of the drawings and following detailed description.

DETAILED DESCRIPTION OF THE PREFERRED EMBODIMENT

Figure 1:
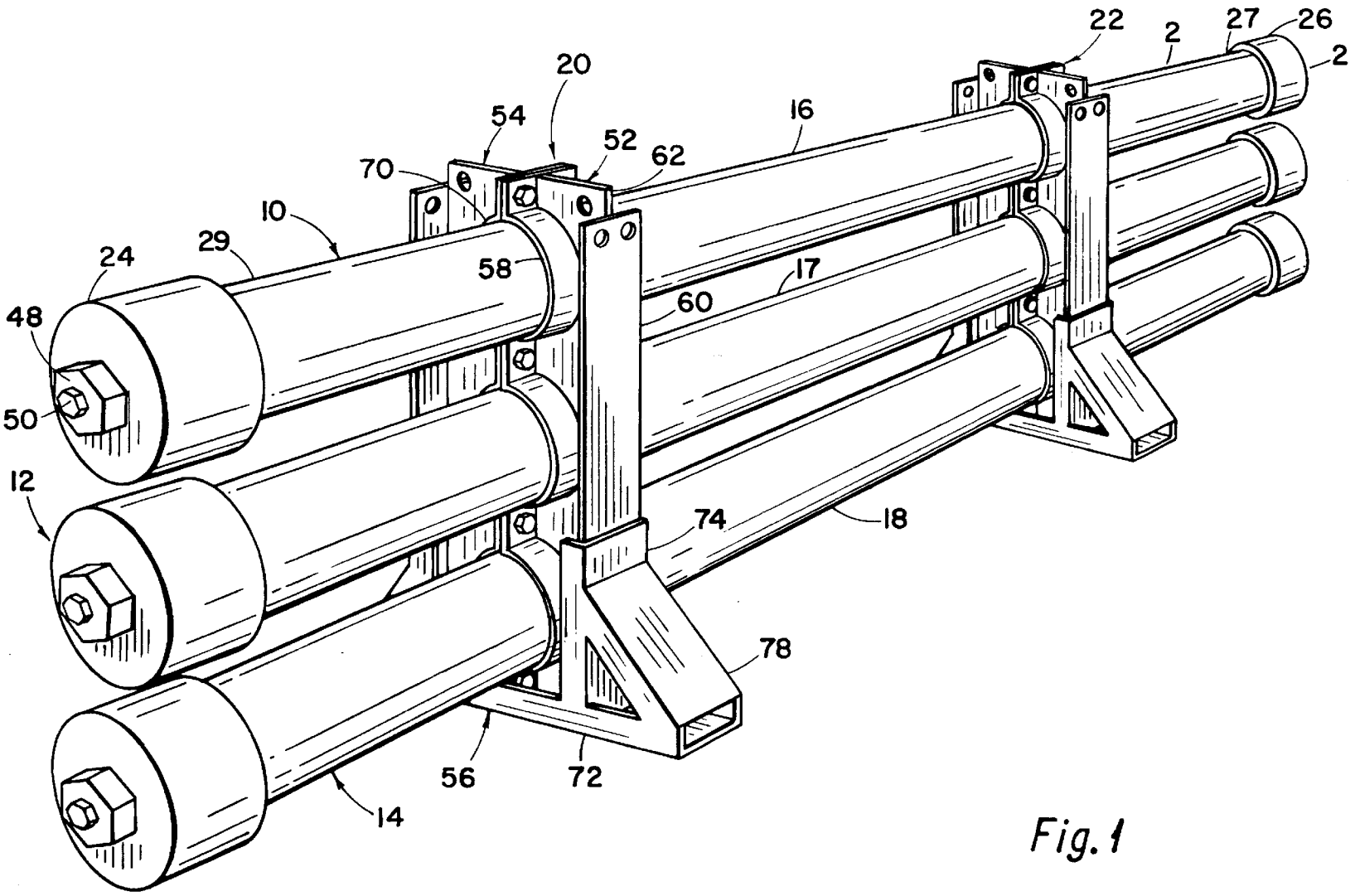
FIG. 1 is an isometric view of the tubular above ground gas storage vessel of this invention where three tubular vessels are secured, or stacked, in a cascade by the support structure.

Referring now to the drawings, where identical or corresponding parts were referred to by the same reference numerals throughout the several views, FIG. 1 is an isometric view of a preferred embodiment of the invention. In FIG. 1, a cascade of three tubular above ground gas storage vessels, numerically 10, 12, and 14, are viewed as they are supported by a pair of support structures, 20 and 22.

When constructed according to this invention, tubular gas storage vessels 10, 12 and 14 are usable for storage of any compressed gas, however, they are particularly suited for storage of compressed natural gas. Such gas storage may either be stationary or mobile as required. Stationary storage of compressed natural gas is required to meet motor vehicle fuel requirements at a fueling station.

Tubular gas storage vessels 10, 12 and 14 may be constructed from any suitable materials such as 9⅝" OD common seamless tubes which require no forging or welding. Tubular casings 16, 17 and 18 of tubular gas storage vessels 10, 12 and 14, respectively, are seamless and rolled to American Society of Mechanical Engineers (ASME) or American Petroleum Institute (API) standards. It should be understood, however, that these tubes are not limited to these standards. Where permitted common oilfield casing milled to API standards could be used. It should also be understood that construction is not limited to seamless tubes as Electric Resistance Weld (ERW) or butt weld tubes can also be used. Seamless welds are preferred because presently ASME de-rates the working pressure of ERW tubes, therefore, seamless tubes provide more storage per dollar.

Tubular casings 16, 17 and 18 can be cut at any length required by particular gas storage requirements. When used for the storage of compressed natural gas, suitable standard lengths of 21' and 42' are possible with the pressure rating (4:1) of 4,340 psi. In such configurations, the tubular gas storage vessels will hold 2,277 SCF in the 21' version and 4,554 SCF in the 42' model (each tube). The preferred tubular gas storage vessels of this invention are designed according to Section VIII, Div. 1 of the ASME Code.

Both ends of each tubular casing 16, 17 and 18 terminate with a cap. Each tubular gas storage vessel 10, 12 and 14 are identical in configuration. For the purpose of exemplification, this description and accompanying reference numerals will be limited to tubular gas storage vessel 10. It is understood that tubular gas storage vessels 12 and 14 are configured in the same manner as vessel 10. Both ends of tubular casing 16 of tubular gas storage vessel 10 are threaded to mate with threads machined on the inner circumference of caps 24 and 26.

Figure 2:
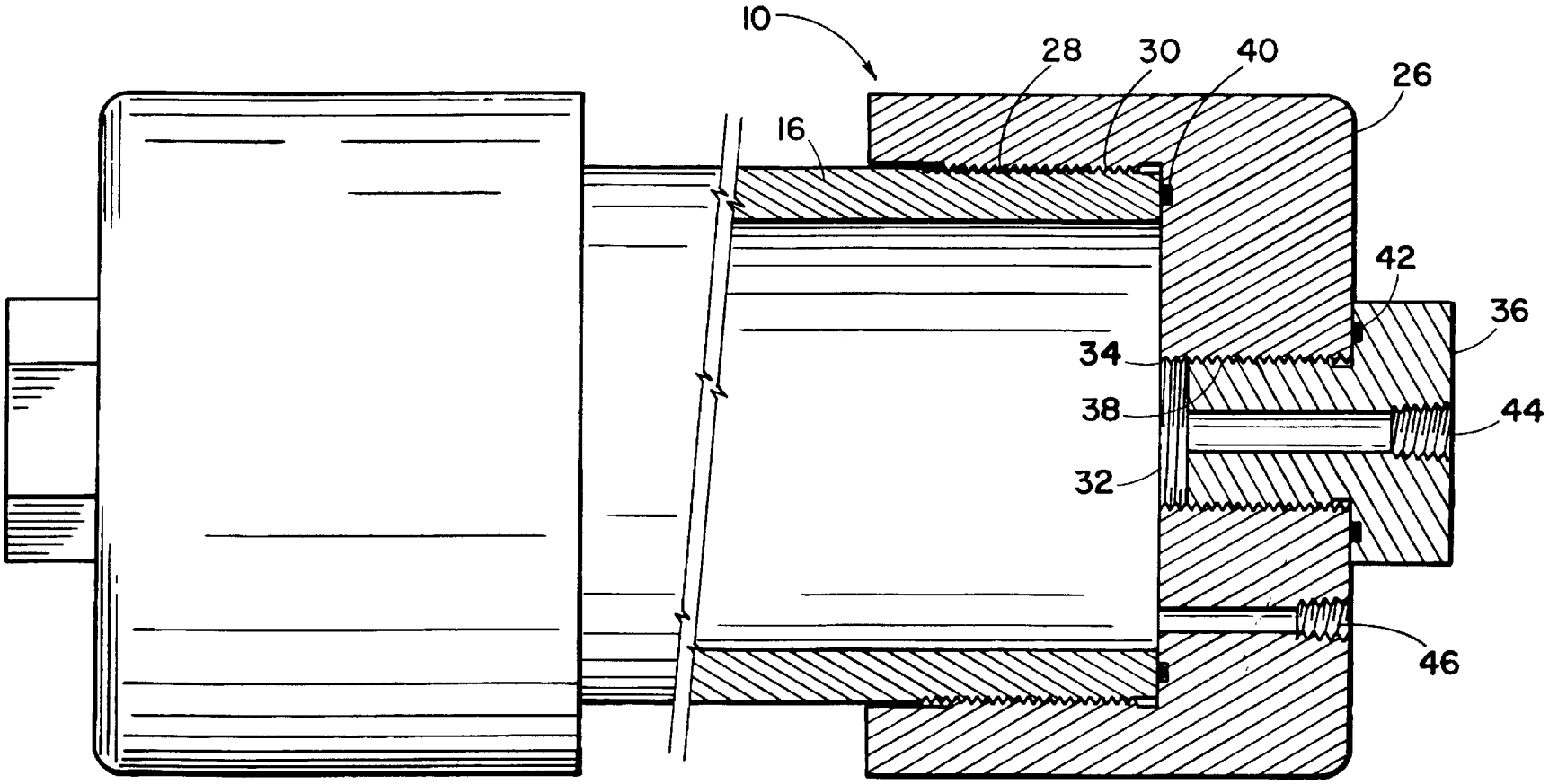
FIG. 2 is a cross-section taken along line 2—2 of FIG. 1.

FIG. 2, a view taken along line 2—2 of FIG. 1, depicts a cross-sectional view of the manner in which tubular casing 16 is sealed by cap 26 on a first end to form a tubular gas storage vessel 10. Tubular casing 16 is machined to terminate with a threaded portion 28. Cap 26 is threaded on its inner circumference 30 so that the threads of the threaded portion 28 of tubular casing 16 mate with the threads of the inner circumference 30 of cap 26. Cap 26 is then screwed onto the end of tubular casing 16. Since both the tube and cap are threaded so that the threads of the tube receive the threads of the cap, no welding, or re-heat treating is required to produce the necessary seal to create gas storage vessel 10, therefore making this design very effective for use as a gas storage vessel while also being easy to manufacture at minimal cost.

In order to help prevent the leakage of the contents of tubular gas storage vessel 10, the inside of cap 26 may be grooved to receive a gasket, or o-ring 40.

An annular passage 32 is drilled in cap 26 in order to provide for the flow of gas to tubular pressure vessel 10. The wall of annular passage 32 within cap 26 is machined to have threads 34 therein. A reducing bushing 36 having the same outer diameter 38 as the diameter of passage 32. is threaded to mate threads 34 of passage 32. Reducing bushing 36 is screwed into passage 32 of cap 26. A groove may be cut in reducing bushing 36 in order to receive a gasket or o-ring 42 to help prevent the escape of the contents of tubular pressure vessel 10.

A central passage 44 is drilled in reducing bushing 36. Central passage 44 is at least partially threaded to receive a gas port to inject gas into tubular gas storage vessel 10. Reducing bushing 36 provides the ability for vessel 10 to receive gas ports of various diameters.

A drain 46 may be drilled into cap 26 at any suitable location. Drain 46 allows access to vessel 10 without disturbing any other fittings. Drain 46 may receive a probe to monitor the pressure in vessel 10 or a plug to provide for the removal of condensation which may result from compression of the gas within vessel 10.

Reducing bushing 36 may receive a gas port but it may be plugged depending upon operational requirements. Referring to FIG. 1, the second end 29 of tubular casing 16 depicts a second cap 24 and a second reducing bushing 48. Reducing bushing 48 in FIG. 1 is sealed with a plug 50.

In a preferred embodiment, the first end of tubular casing 16 will have a reducing bushing, such as 36 of FIG. 2, which receives a gas port to allow the flow of gas into and out of vessel 10. As shown in FIG. 1, the second end of tubular casing 16 will then have a second reducing bushing 48 which is sealed with plug 50 to allow compressed gas to be stored within vessel 10. It is understood, however, that the second reducing bushing 48 could also receive a gas port, or be configured so that tubular gas storage vessels 10, 12 and 14 are connected to one another (not shown).

Figure 5:
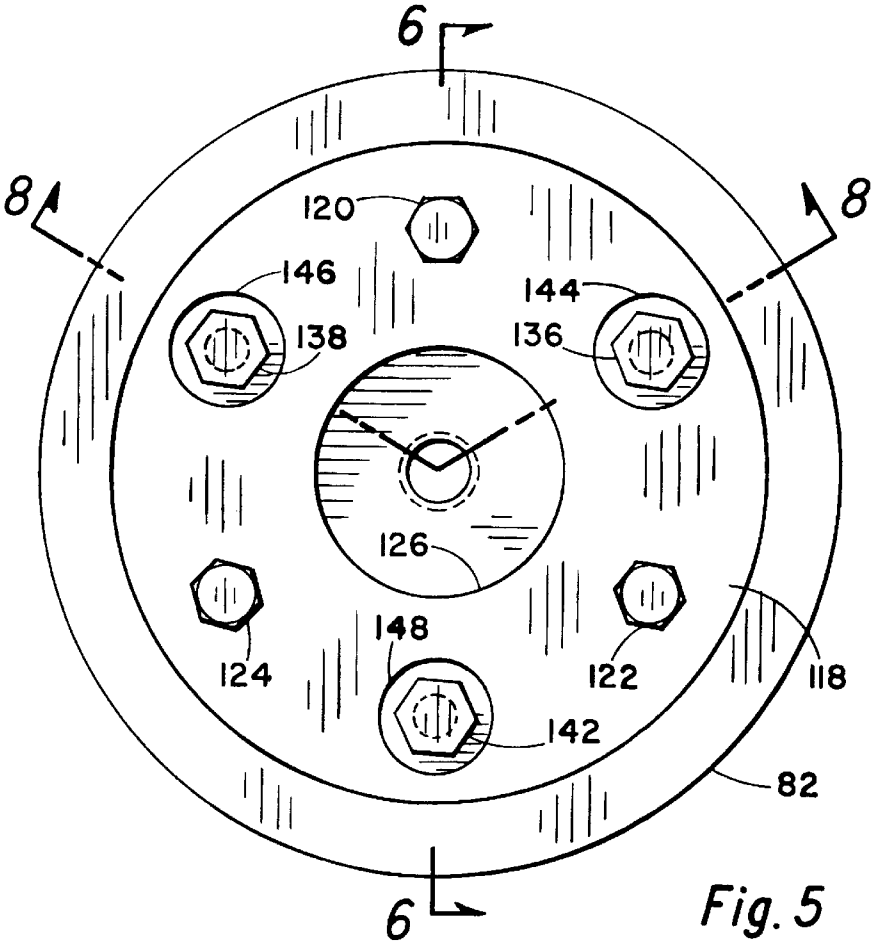
FIG. 5 is an end view of the tubular above ground gas storage vessel of this invention depicting an alternative means of securing the plugs to the tube.

FIG. 5 is an end view of the above-ground storage vessel of this invention depicting. an alternative assembly for closing the ends of the tube. In this embodiment, the ends of the tube are not threaded to receive a cap but rather an internal plug is secured into the ends of the tube in order to seal the pressure vessel.

Figure 6:
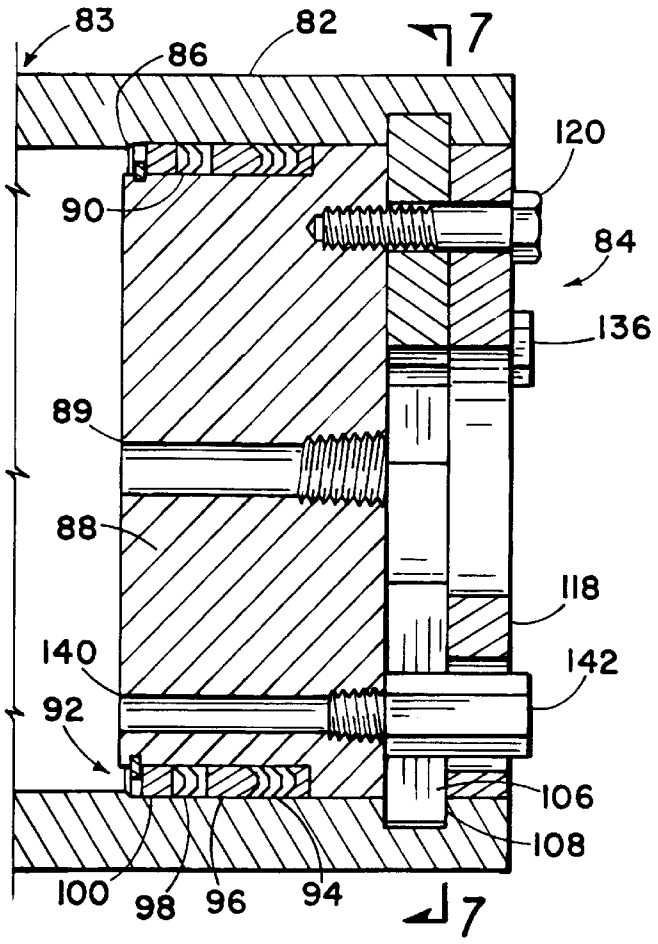
FIG. 6 is a view taken along line 6—6 of FIG. 5.

Referring to FIG. 6, a view taken along line 6—6 of FIG. 5, a first end 82 of a tube 83 with this alternative embodiment can be seen. Tubes of this design can be substituted for those shown in FIG. 1. In order to receive the plug assembly, generally 84 of this embodiment, the inner diameter of each end of the tube 83 may be slightly enlarged. In FIG. 5, first end 82 of tube 83 has an enlarged section 86. This enlarged section 86 of first end 82 is of a length sufficient to receive the entire cap assembly 84.

The closure assembly 84 includes plug 88 of a diameter that equals the internal diameter of the enlarged section 86 of the first end 82. A central passage 89 is drilled into cap 88. Central passage 89 is at least partially threaded to receive a gas port so that the gas being stored in tube 83 may be injected or released as required.

Plug 88 contains an annular shoulder 90 of reduced diameter which is inserted into first end 82 of tube 83. Shoulder 90 has a reduced diameter as compared with the rest of plug 88 so that packing 92 may be inserted between plug 88 and enlarged section 86.

Figure 8:
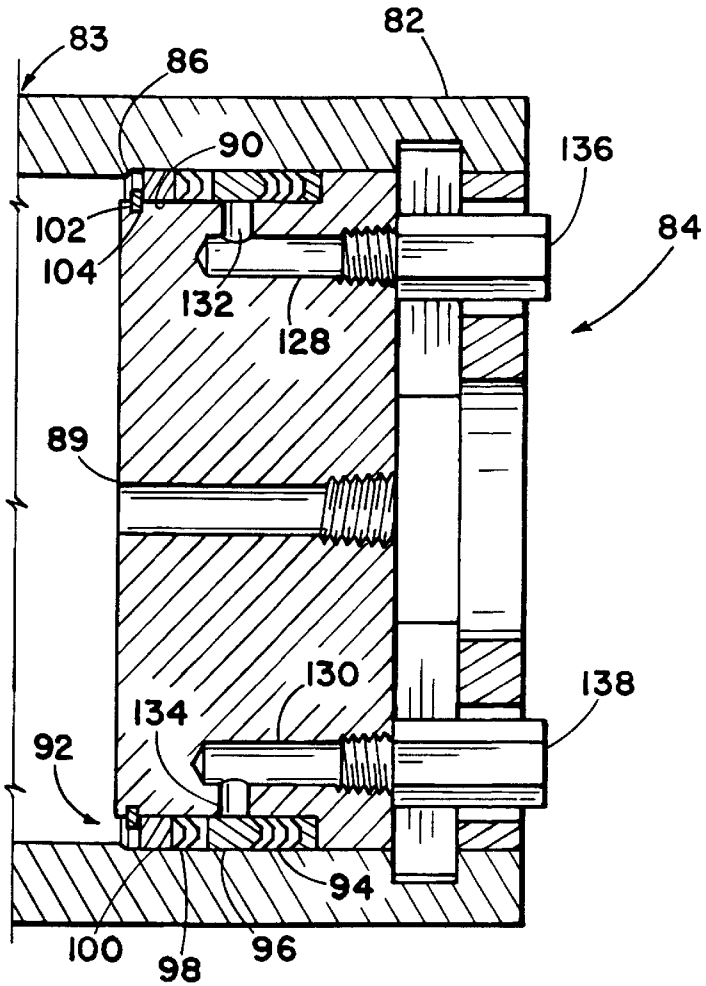
FIG. 8 is a view taken along line 8—8 of FIG. 5.

Reference is now made to FIG. 8, a view taken along line 8—8 of FIG. 5. Prior to inserting plug 88 into first end 82 of tube 83, packing is placed around plug 88 on shoulder 90. Packing 92 consists of a series of chevron rings 94 fit against one another in a stacked arrangement. A material 96 is inserted as a part of packing 92 against chevron rings 94. Material 96 is injectable packing used in the art for high pressure applications. This injectable packing material 96 is moldable by hand, formed into a wad ring and inserted against chevron rings 94. Once material 96 is inserted, a second set of chevron rings 98 are inserted against material 96. Following rings 96 is a metal support ring 100 which prevents packing 92 from extruding into the interior of the tube.

A snap ring 102 is fit over plug 88 into a snap ring groove 104 cut into plug 88. The function of snap ring 102 is to hold packing 92 in place, both before and after plug 88 is inserted into first end 82 of tube 83. After packing 92 is secured to plug 88, plug 88 is inserted into first end 82.

Referring to FIG. 6, once plug 88 including packing 92 is inserted into first end 82, a retainer plate 106 is secured. Retainer plate 106 has a diameter greater than the inside diameter of enlarged section 86 of first end 82. A retainer plate groove 108 is cut inside first end 82 to receive retainer plate 106.

Figure 7:
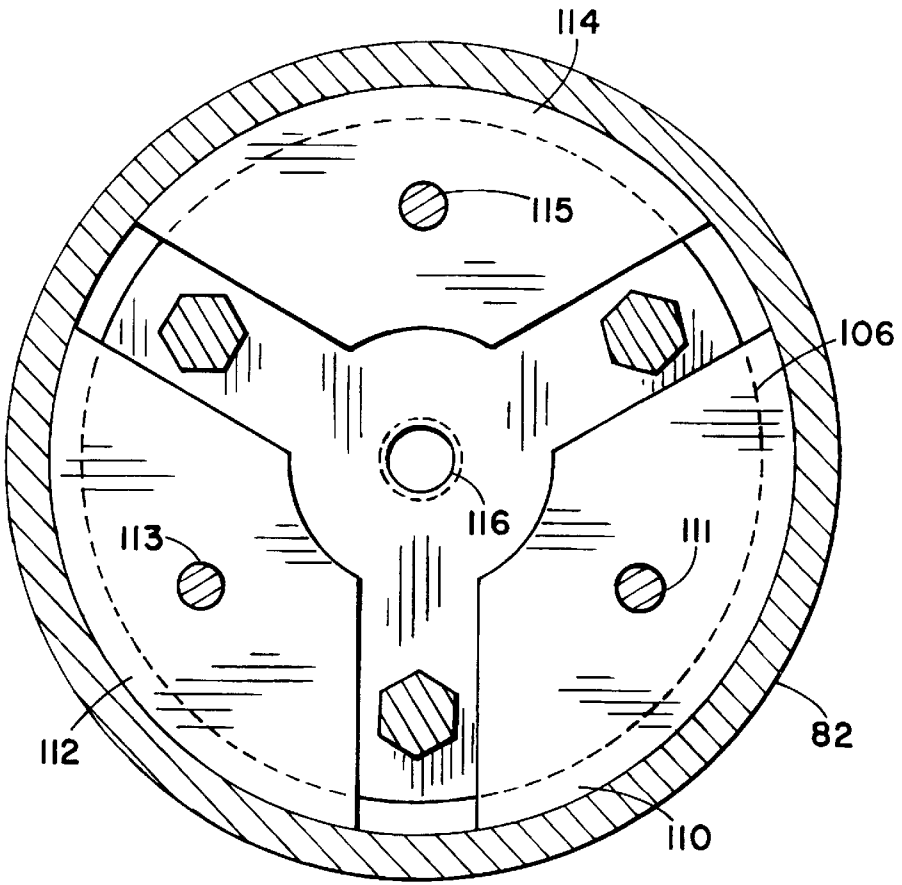
FIG. 7 is a view taken along line 7—7 of FIG. 6.

Referring to FIG. 7, a view taken along line 7—7 of FIG. 6, retainer plate 106 consists of three segments, 110, 112 and 114. These segments, 110, 112 and 114, enable retainer plate 106 to be fit inside retainer plate groove 108 of FIG. 6. Retainer plate 106 contains a central passage 116 to allow a gas port to be inserted through. Holes 111, 113 and 115 are drilled in segments 110, 112 and 114 respectively of retainer plate 106 to allow bolts to be inserted there through.

After retainer plate 106 is secured in retainer groove 108, a washer 118 is mounted inside first end 82. Washer 118 is mounted flush with the end of first end 82 of tube 83. Washer 118 has a plurality of holes drilled through it so that a series of bolts, fittings and a plug may be inserted. After the entirety of the closure assembly 84 is inserted into first end 82, bolt 120 is inserted through washer 118, retainer plate 106 and screwed into plug 88. Two additional bolts (not shown) are screwed into plug 88 in the same manner as bolt 120. FIG. 5 shows these bolts 120, 122 and 124 which are spaced approximately 120° around a circumference of washer 118. Although bolts 120, 122 and 124 are used in this embodiment, it is understood that any number can be used to secure the closure assembly 84 in first end 82. Washer 118 has a central passage 126 in order to allow insertion of a gas port to be screwed into plug 88.

Referring to FIG. 8, a view taken along line 8—8 of FIG. 5, in order to energize packing 92, a plurality of passages are drilled into plug 88. Two horizontal passages 128 and 130 are drilled in plug 88 prior to insertion into tube 83 and prior to installation of packing 92. In addition, horizontal passages 128 and 130 are drilled only a part of the way through plug 88. Two vertical passages 132 and 134 are drilled in plug 88 from shoulder 90 to intersect with horizontal passages 128 and 130. Vertical passages 132 and 134 are positioned to intersect with material 96 of packing 92.

In order to energize packing 92, vertical passage 132 and horizontal passage 128 are filled with the same packing material as 96. An injection fitting 136 with threads mating the threads of horizontal passage 128 is screwed into horizontal passage 128. Injection fitting 136 is available commercially and consists of a body, a check valve, and an injection screw. Fitting 136 is filled with packing material which is forced into horizontal passage 128 by the screw in fitting 136. This, in turn, forces the packing material inside the horizontal passage 128 into vertical passage 132 and out into shoulder 90 and compresses material 96. Additional packing may be added as required. While packing 92 is being energized, horizontal passage 130 and vertical passage 134 are left open to allow air to escape which was previously trapped in pockets inside material 96. In addition, excess material 96 can also escape. Once the packing has been energized, plug 138 is screwed into horizontal passage 130.

Once the tube has been pressurized, additional packing material 96 may be added to seal leaks should they develop without removing the closure assembly 84. This provides a feature not previously known in the art.

As shown in FIG. 6, a third partially threaded horizontal passage 140 is drilled through plug 88. Horizontal passage 140 is distinct from horizontal passages 128 and 130 of FIG. 8 in that it continues entirely through plug 88. Horizontal passage 140 serves as a drain for the removal of condensation from tube 83 or may receive a probe to monitor the gas pressure within tube 83. Tube 83 is positioned for use so that horizontal passage 140 is located at the bottom of tube 83. Horizontal passage 140 is sealed by a plug 142. Plug 142 has threads mating the threads in horizontal passage 140 so that plug 142 is screwed into horizontal passage 140.

FIG. 5 shows bolts 120, 122 and 124 spaced approximately 120° around washer 118. Fittings 136, 138 and plug 142 are, likewise spaced 120° around the circumference of washer 118. In a preferred embodiment, therefore, bolts 120, 122 and 124, fitting 136, and plugs 138 and 142 are spaced 60° from each other as shown in FIG. 5. It is understood that any suitable configuration could be an alternative to this arrangement.

Holes 144, 146 and 148 are drilled through washer 118 and are of a diameter to allow fittings 136, and plugs 138 and 142 to be inset. In FIG. 7 it can be seen that plate segments 110, 112 and 114 of retainer plate 106 are spaced to allow fitting 136, and plugs 138 and 142 to be screwed flush with plug 88 in order to obtain a proper seal.

In FIG. 1, a plurality of tubular gas storage vessels, 10, 12 and 14 are supported in vertical-parallel fashion by support structures 20 and 22. Support structures 20 and 22 allow tubular pressure vessels 10, 12 and 14 to be arranged in a cascade providing increased storage capability while taking up a minimum of ground space, or footprint. Although a cascade of three to five tubular gas storage vessels would be most practical, it should be understood that any number of any size tubular gas storage vessels may be in a cascade. Several such cascades could be positioned next to one another making the tubular gas storage vessels of this invention versatile to meet any gas storage requirements.

Support structures 20 and 22 provide rigid, vertical-parallel support for a cascade of vessels 10, 12 and 14. Since support structures 20 and 22 are identical, for the purpose of exemplification, this description and accompanying reference numerals will be limited to support structure 20.

Figure 3:
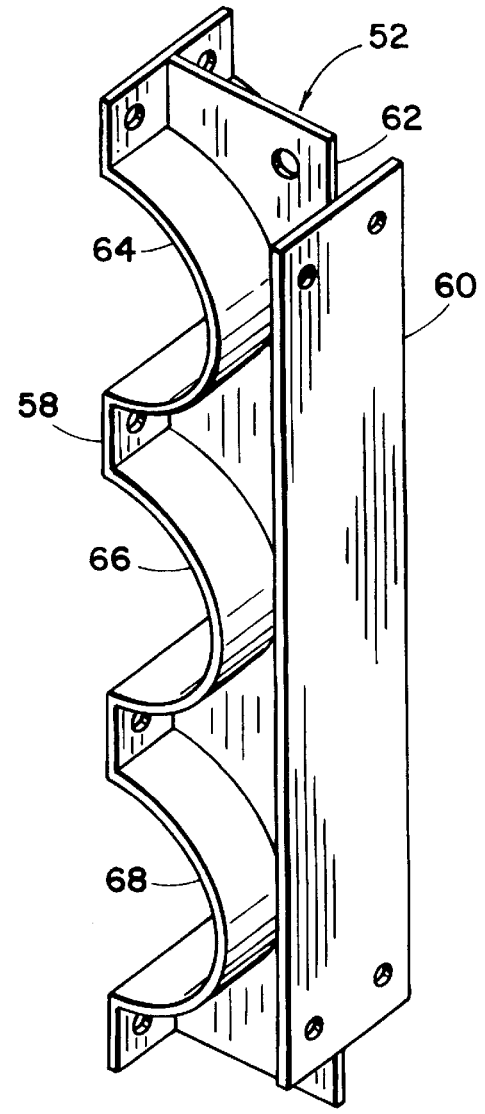
FIG. 3 is an isometric view of a support bracket for a plurality of above ground gas storage vessels of this invention.

Support structure 20 includes two vessel clamps 52 and 54 and support base 56. FIG. 3 illustrates vessel clamp 52 of support structure 20. Vessel clamp 52 includes a vessel cradle 58, a plate 60 and a contoured spacer 62. Vessel cradle 58 contains a number of semi-circular concave portions 64, 66 and 68. A number of semi-circular concave portions of vessel cradle 58 would equal the number of tubular gas storage vessels in the cascade. Concave portions 64, 66 and 68 are semi-circular in order to conform to the circular outer circumference of tubular gas storage vessels 10, 12 and 14, such that when vessel clamps 52 and 54 of FIG. 1 are secured together, the vessel cradles 58 and 70 will match up to conform to the outer diameter of the tubular gas storage vessels 10, 12 and 14.

Referring to FIG. 3, contoured spacer 62 connects vessel cradle 58 with plate 60. Contoured spacer 62 is contoured so as to follow semi-circular concave portion 64, 66 and 68 and provide a flat, linear surface onto which plate 60 may be attached. Contoured spacer 62 may be fixed to vessel cradle 58 and plate 60 by any suitable fashion known in the art.

Figure 4:
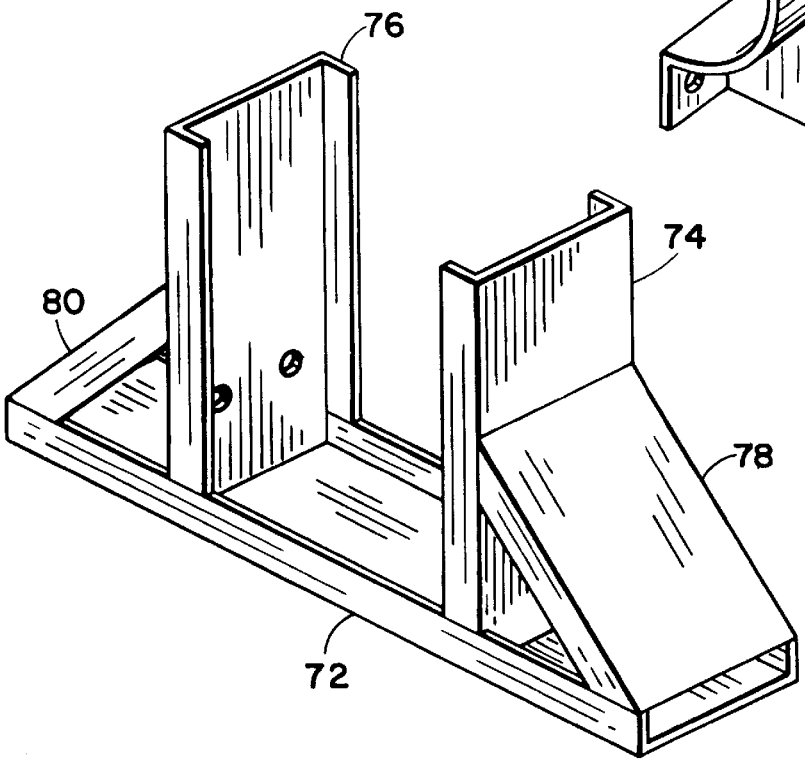
FIG. 4 is an isometric view of a support base for a cascade of tubular above ground gas storage vessels of this invention.

Referring to FIG. 4, support base 56 includes a horizontal foot 72 upon which two vertical channels 74 and 76 are secured perpendicular to horizontal foot 72. Vertical channel 74 and 76 are secured a distance from the distal ends of horizontal foot 72. Braces 78 and 80 extend from horizontal foot 72 and are secured to channels 74 and 76 respectively. Braces 78 and 80 maintain vertical channel 74 and 76 in their perpendicular association with horizontal foot 72. Plate 60 of FIG. 3 provides a flat surface which is received by vertical channel 74 of FIG. 4.

As seen in FIG. 1, vessel clamps 52 and 54 are secured to one another such that tubular gas storage vessels 10, 12 and 14 are clamped in a vertical-parallel arrangement, or cascade. Plate 60 is received by vertical channel 74 such that vessel clamp 52 and 54 are maintained perpendicular to horizontal foot 72.

Vessel clamps 52 and 54 are secured together by any suitable means. In a preferred embodiment, vessel clamps 52 and 54 are bolted to one another. Likewise, plate 60 is secured to vertical channel 74 by any suitable manner. In a preferred embodiment, plate 60 is nested and bolted into vertical channel 74 of support base 56. It is understood that vessel clamp 54 is likewise secured into support base 56 in the same manner as vessel clamp 52. In another form one or a plurality of assembled gas storage vessels 10 retained by clamps 52 and 54 can be aligned vertically and horizontally without the support base 56. Adjacent assembled vessels can be connected by bolting adjoining plates 60.

A plurality of tubular gas storage vessels may be supported in a cascade in FIG. 1 by support structures 20 and 22. The number of such support structures is dependent upon the length of the tubular gas storage vessels requiring support. The length of tubular gas storage vessels is, likewise, dependent upon gas storage requirements. This invention, therefore, provides a lightweight pressure vessel that is economical to construct, lightweight in design, and highly versatile in use.

Figure 9:
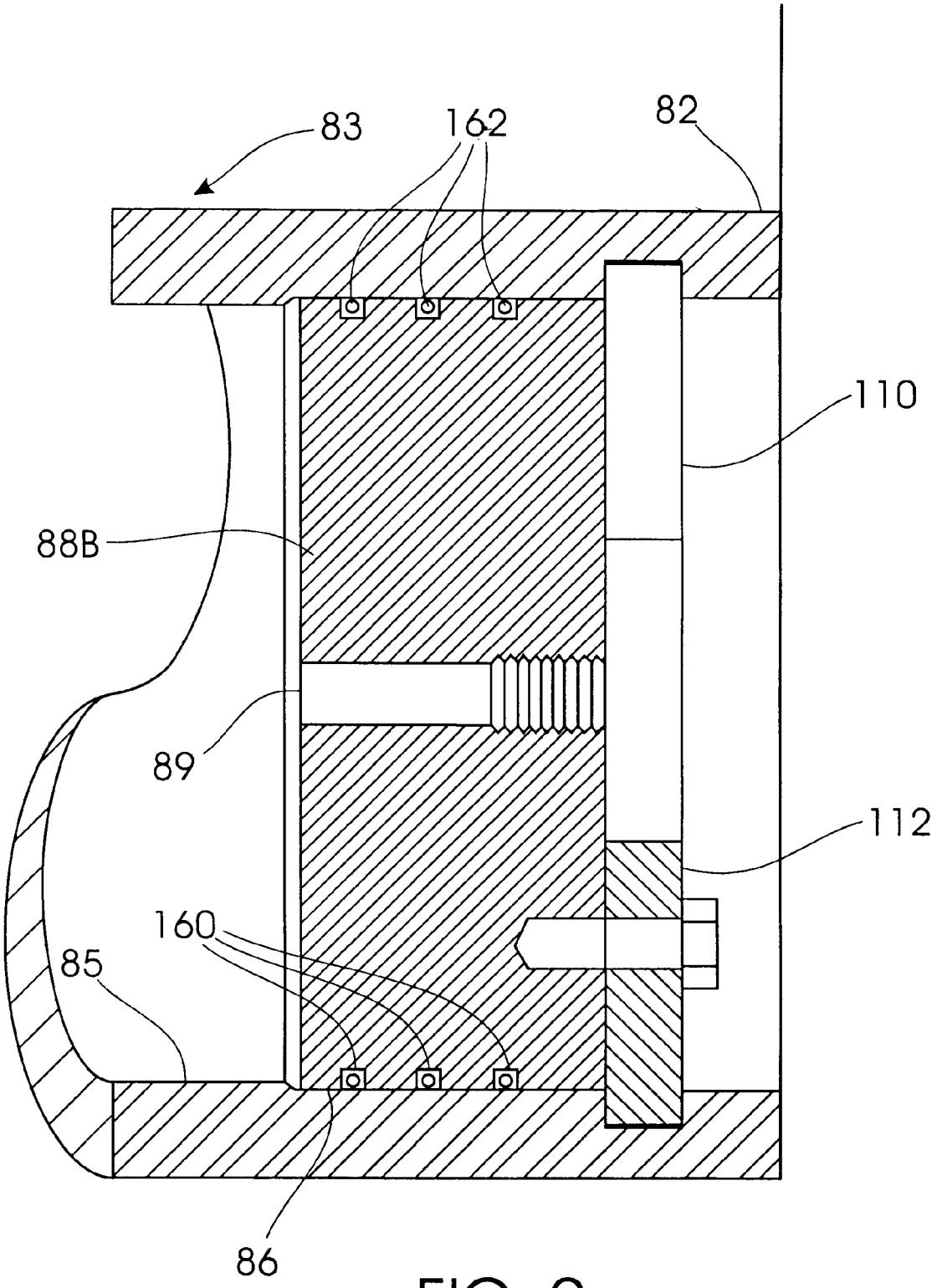
FIG. 9 is a sectional view of an alternate embodiment of this invention utilizing O-rings.
Figure 10:
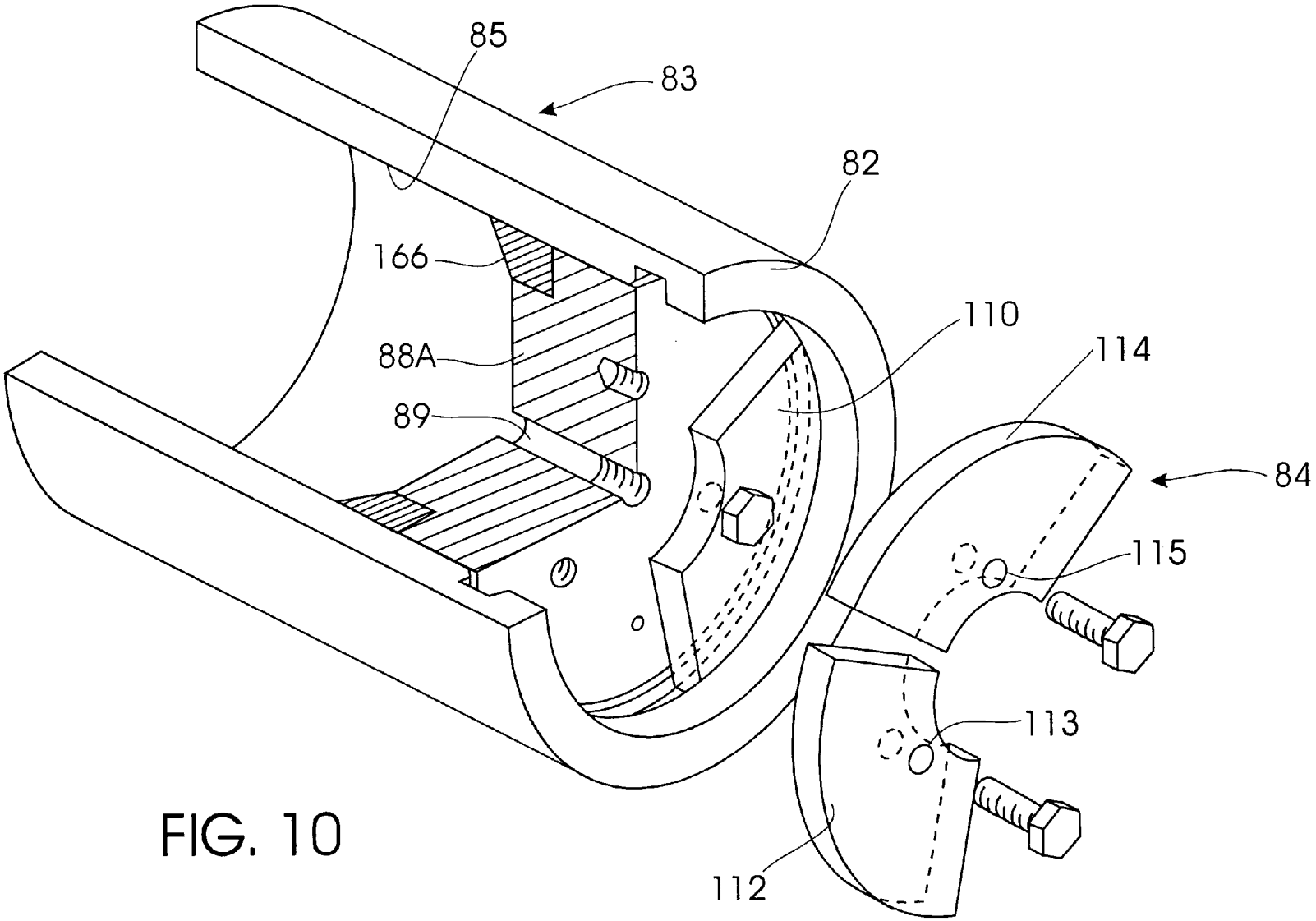
FIG. 10 is a perspective view of the invention involving the concept with a single, bevelled packing ring.

In FIGS. 9 and 10 like numerals for like parts previously described are used. In this embodiment at least one but preferably a plurality of peripheral O-ring grooves 160 in plug 88B are utilized to accept O-rings 162 to seal relative to the internal diameter 85 or as shown within the recessed diameter portion 86. In the embodiment of FIG. 10 a bevelled packing member 166 is utilized in tubing 83 which to seal between the plug 88A and the internal diameter 85 or within a larger diameter recessed portion such as 86 in FIG. 9 but not shown in this view.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A tubular above ground gas storage vessel, comprising:

a tube with a first end and a second end and an inner diameter and an outer diameter;

a first plug in said first end of a diameter substantially the same as the inner diameter of the tube so as to fit internally therein;

said first plug containing at least one inner shoulder of a diameter less than said diameter of said tube;

said plug containing a partially threaded passage therethrough to receive a gas port;

means, in said inner shoulder to seal said first plug in the tube to prevent the escape of gas from the tube;

means to secure said first plug in the tube;

a second plug secured in the tube at said second end thereof.

2. A tubular above ground gas storage vessel, as in claim 1, wherein the means to secure said first plug in the tube includes:

a retainer ring of a diameter greater than the inner diameter of the tube which is secured in a retainer ring groove cut in the inner diameter of the tube positioned in the tube between the plug and the first end;

a washer of a diameter equal to the inner diameter of the tube positioned in the tube between the retainer ring and the first end;

a plurality of bolts extending through the washer and retaining ring which are screwed into the plug in order to secure the washer, the retaining ring and the plug to each other.

3. A tubular above ground gas storage vessel as in claim 2 wherein said retainer ring comprises three segments.

4. The storage vessel of claim 1 wherein said means to seal includes a single packing ring within said shoulder.

5. A tubular above ground gas storage vessel, comprising:

a tube with a first end and a second end and an inner diameter;

said tube having a section at said first end of internal diameter larger than said inner diameter of said tube;

a first plug of a diameter substantially the same as said internal diameter of said section so as to fit therein;

said first plug containing at least a partially threaded passage therethrough for receiving a closable gas port threaded therein;

means to seal said first plug in the tube relative to said internal diameter to prevent the escape of gas from the tube;

means to secure said first plug in the tube;

a second plug secured in the tube at the second end thereof, said second plug containing a partially threaded passage therethrough.

6. The storage vessel of claim 5 wherein said means to seal said first plug in the tube includes at least one peripheral O-ring.

7. A tubular above ground gas storage vessel, as in claim 5, wherein the means to secure said first plug in the tube includes:

a retainer ring of a diameter greater than the inner diameter of the tube which is secured in a retainer ring groove cut in the inner diameter of the tube positioned in the tube between said first plug and the first end;

a washer of a diameter equal to the inner diameter of the tube positioned in the tube between the retainer ring and the first end; and a plurality of bolts extending through the washer and retaining ring which are screwed into said first plug in order to secure the washer, the retaining ring and the plug to each other.

8. A tubular above ground gas storage vessel as in claim 7 wherein said retainer ring comprises three segments.

9. An assembly, comprising:

a plurality of tubular gas storage vessels;

each tubular storage vessel having a first end and a second end and an inner diameter and an outer diameter;

said tubular storage vessels each having a section at said first end of internal diameter larger than said inner diameter of said tubular storage vessels;

a first plug of a diameter substantially the same as said internal diameter of said section;

said first plug containing at least a partially threaded passage for receiving a closable gas port;

means to seal said first plug in the tubular storage vessel relative to said internal diameter to prevent the escape of gas from the tubular storage vessel;

means to secure said first plug in the tubular storage vessel;

a second plug secured in the tubular storage vessel at said second end thereof; and at least one pair of vessel clamps, each clamp having a plurality of semi-circular concave portions which, when mated, creates a circular cradle for each said vessel, and means to retain each pair together.

10. The assembly of claim 9, including a support base, means to receive and retain said pairs of vessel clamps whereby the tubular gas storage vessels are retained by the vessel clamps in parallel relationship to one another.

11. A tubular above ground storage vessel, as in claim 2, wherein:

said second plug in the tube at said second end thereof is secured with a second retaining ring of a diameter greater than said inner diameter of the tube, said second retaining ring secured in a retainer ring groove cut in said inner diameter of the tube positioned in the tube between said second plug and said second end;

a washer of diameter equal to said inner diameter of the tube is positioned in the tube between said second retainer ring and said second end; and said second plug contains a partially threaded passage therethrough for receiving a second closable gas port through which gas may flow.

12. A tubular above ground storage vessel, as in claim 1, wherein said second plug is threadable into said tubular above ground storage vessel.

13. A tubular above ground storage vessel, as in claim 1, further comprising a plug threadable into said partially threaded passage to close said gas port.

* * * * *